US005901648A

United States Patent [19]

Roland et al.

[11] Patent Number: 5,901,648

[45] Date of Patent: May 11, 1999

[54] DEVICE FOR ADJUSTING PRINTING UNIT CYLINDERS IN PRINTING UNITS OF ROTARY PRINTING PRESSES

[75] Inventors: Franck Roland, Chantilly; Franck Bausela, Creil, both of France

[73] Assignee: Heidelberger Druckmaschinen AG, Heidelberg, Germany

[21] Appl. No.: 08/979,138

[22] Filed: Nov. 26, 1997

[30] Foreign Application Priority Data

Nov. 28, 1996 [FR] France ..... 96 14581

[51] Int. Cl.[6] ..... B41F 7/02

[52] U.S. Cl. ..... 101/218; 101/225; 101/247

[58] Field of Search ..... 101/218, 216, 101/219, 247, 220, 225, 232, 182

[56] References Cited

U.S. PATENT DOCUMENTS

| | | | |
|---|---|---|---|
| 1,423,792 | 7/1922 | Gowdy | 101/349.1 |
| 3,593,662 | 7/1971 | Gates | 101/218 |
| 4,643,090 | 2/1987 | McKrell et al. | 101/218 |
| 5,237,920 | 8/1993 | Guaraldi | 101/216 |
| 5,301,609 | 4/1994 | Guaraldi et al. | 101/216 |
| 5,337,664 | 8/1994 | Hannon | 101/218 |
| 5,520,109 | 5/1996 | Meschl | 101/247 |
| 5,617,789 | 4/1997 | Achelpohi et al. | 101/216 |
| 5,678,485 | 10/1997 | Guaraldi | 101/216 |
| 5,813,336 | 9/1998 | Guaraldi et al. | 101/218 |

FOREIGN PATENT DOCUMENTS

| | | |
|---|---|---|
| 0193012A2 | 9/1986 | European Pat. Off. . |
| 0625423A1 | 11/1994 | European Pat. Off. . |

*Primary Examiner*—Eugene Eickholt
*Attorney, Agent, or Firm*—Herbert L. Lerner; Laurence A. Greenberg

[57] ABSTRACT

Device for adjusting printing-unit cylinders in a printing unit of a rotary printing press for printing on both sides of a material web, the printing-unit cylinders including printing-form cylinders with exchangeable printing forms, one of the printing-unit cylinders being held stationary in the printing unit, includes an auxiliary adjusting unit for maintaining a gap traversible by the material web, the gap being formed between outer cylindrical surfaces of two of the printing-unit cylinders disposed adjacent to a path of the material web through the printing unit, the gap being maintainable by the auxiliary adjusting unit independently of adjusted positions of others of the printing-unit cylinders.

12 Claims, 4 Drawing Sheets

DEVICE FOR ADJUSTING PRINTING UNIT CYLINDERS IN PRINTING UNITS OF ROTARY PRINTING PRESSES

BACKGROUND OF THE INVENTION

FIELD OF THE INVENTION

The invention relates to a device for adjusting printing unit cylinders in printing units of rotary printing presses, particularly when a material web remains in the printing units.

The published European Patent Document EP 0 596 244 A1 is concerned with a printing unit having a releasable bearing attachment. The printing unit includes a blanket cylinder, a bearing and an assembly gate. A sleeve-shaped printing blanket is disposed on the blanket cylinder, and the bearing has a bearing housing which is fastened to a stub shaft at an end of the blanket cylinder. The assembly gate includes a gate which is rotatably mounted on a frame wall of the printing unit. In a closed position, the gate covers an opening formed in the frame wall and, in an opened position, the opening is exposed. The bearing housing is clamped by a clamping device to the gate when the blanket cylinder rotates during the printing process. The clamping device has a first clamping jaw which is fastened to the gate, and a second clamping jaw disposed on the gate so as to be movable relative to the first clamping jaw. The first clamping jaw is in contact with the bearing housing, and the second clamping jaw is movable into and out of contact with the bearing housing when the gate is closed. During disengagement, the assembly gate is moved with the blanket cylinder.

The published European Patent Document EP 0 625 423 A1 discloses a printing unit with an oblique adjustment device and a shut-down device. A printing unit includes a frame, a first and a second support bracket and a lower and an upper plate cylinder. The first support bracket is movably mounted on the frame. An end of the upper plate cylinder is mounted so that it moves with the first support bracket. The second support bracket is also movably mounted on the frame. An end of the lower printing unit cylinder is mounted so that it moves with the second support bracket. The printing unit further includes an oblique adjustment device and a shut-down device. The oblique adjustment device moves the support brackets independently of one another transversely to the frame. The shut-down device includes an adjustment cylinder and a piston rod, which are disposed between the two support brackets. The adjustment cylinder and the piston rod are pivotally connected to the support brackets and can be pivoted with respect to these support brackets when the latter are transversely adjusted by the oblique adjustment device. Via the shut-down device, the support brackets can be obliquely disposed independently of one another, while they remain connected to one another, however, for the shut-down operation.

With the foregoing construction, the blanket cylinders always come into contact with one another automatically upon the engagement of the upper and the lower plates, respectively, and the blanket cylinder, respectively. This forcible coupling of the blanket cylinder adjustment quite considerably aggravates or complicates the automatization of the printing-form exchange. The material web remaining between the blanket cylinders in the printing unit can tear during the printing-form exchange and during the application or mounting of the printing form on the plate cylinder, respectively, which results in a costly reinsertion of the material web and accompanying time loss.

A remedy may indeed be provided by removing the lower printing unit cylinder and the blanket sleeve on the lower printing unit cylinder, respectively, in order to exchange the printing form on the upper plate cylinder, and the reverse, however, this is likewise a time-consuming solution.

SUMMARY OF THE INVENTION

It is accordingly an object of the invention to provide a device for adjusting printing unit cylinders in printing units of rotary printing presses whereby upper and lower printing unit cylinders, respectively, are capable of being adjusted without damaging a material web located in the printing unit within a gap between blanket cylinders.

With the foregoing and other objects in view, there is provided, in accordance with the invention, a device for adjusting printing-unit cylinders in a printing unit of a rotary printing press for printing on both sides of a material web, the printing-unit cylinders including printing-form cylinders with exchangeable printing forms, one of the printing-unit cylinders being held stationary in the printing unit, comprising an auxiliary adjusting unit for maintaining a gap traversible by the material web, the gap being formed between outer cylindrical surfaces of two of the printing-unit cylinders disposed adjacent to a path of the material web through the printing unit, the gap being maintainable by the auxiliary adjusting unit independently of adjusted positions of others of the printing-unit cylinders.

In accordance with another feature of the invention, the adjusting device is provided with a primary adjusting unit for opening and closing, independently of the position of transfer cylinders disposed in upper and lower parts of the printing unit, a gap formed between one of the printing-unit cylinders disposed in the upper part of the printing unit and the transfer cylinder also disposed in the upper part of the printing unit.

In accordance with a further feature of the invention, the adjusting device is provided with a primary adjusting unit for opening and closing, independently of the position of transfer cylinders disposed in upper and lower parts of the printing unit, a gap formed between one of the printing-unit cylinders disposed in the lower part of the printing unit and the transfer cylinder also disposed in the lower part of the printing unit.

In accordance with an added feature of the invention, the printing-unit cylinders are disposed in both an upper and a lower printing-unit part, the auxiliary adjusting unit being assigned to the upper printing-unit part.

In accordance with an additional feature of the invention, the printing-unit cylinders are disposed in both an upper and a lower printing-unit part, the auxiliary adjusting unit being assigned to the lower printing-unit part.

In accordance with yet another feature of the invention, the printing-unit cylinders are disposed in both an upper and a lower printing-unit part, and a printing-unit cylinder bearing support is disposed in the lower printing-unit part, the auxiliary adjusting unit being assigned to the cylinder bearing support in the lower printing-unit part.

In accordance with yet a further feature of the invention, the adjusting device includes a web guidance unit disposed in the printing unit at a web-infeed side thereof, the web guidance unit having a protective element insertable into the gap.

In accordance with yet an added feature of the invention, the adjusting device includes a slider whereon the insertable protective element is held.

In accordance with yet an additional feature of the invention, the adjusting device includes a control unit assigned to the slider for actuating the slider.

In accordance with still another feature of the invention, the adjusting device includes an upper, a lower and an intermediate displaceable bearing support for the printing-unit cylinders, and a frame-fixed bearing support located adjacent to the intermediate bearing support, and an adjusting element for the auxiliary adjusting unit displaceable between the frame-fixed bearing support and the intermediate bearing support.

In accordance with still a further feature of the invention, the intermediate bearing support is formed with a stop surface.

In accordance with a concomitant feature of the invention, the adjusting device includes an upper and a lower bearing support for the printing-unit cylinders, the lower bearing support being formed with a stop surface.

Through the device according to the invention, there is provided, in a most advantageous manner, the possibility of exchanging a printing form while the material web remains in the printing unit, both in the lower as well as in the upper part thereof. Because the respective printing-unit cylinders in the upper and in the lower printing-unit parts, respectively, can be engaged with one another and disengaged from one another, respectively, without impairing or encroaching upon the gap between the outer cylindrical surfaces of transfer cylinders through which the web is guided, the printing forms can be pretensioned and fully or finally clamped or locked by the respectively disengaged transfer cylinder through the utilization of the pressure-applying effect. The danger of tearing the material web does not exist any more, and a new insertion of the material web can be dispensed with.

In further realizations of the concepts according to the invention, a control or adjusting unit closes or opens an upper gap formed between the upper printing-form cylinder and the transfer cylinder, in a first adjusted position, independently of the position of the transfer cylinder. The printing form in the upper printing-unit part can thereby be exchanged without having to change the adjusted position of the transfer cylinder forming the gap for the material web.

The aforementioned control or adjusting unit closes or opens a lower gap formed between the lower printing-form cylinder and the lower transfer cylinder independently of the position of this transfer cylinder. The auxiliary control or adjusting unit maintaining the gap for the material web can be assigned to the upper printing-unit part and the lower printing-unit part, and also to a lower printing-unit cylinder bearing support. The auxiliary control or adjusting unit is so placed in all of the aforementioned three cases that the movement of the transfer cylinders, which are the cylinders located adjacent to the material web, remain forestalled.

In addition to the auxiliary control or adjusting unit at the printing unit, the latter also includes a web-guidance unit which, on its part, includes protective elements insertable into the gap defined by the transfer cylinders. The protective elements are formed as sliders which are actuable by these assigned control or adjusting units which are, for example, pneumatic adjusting cylinders or the like. Through the intermediary of the web-guidance unit, the web can be effectively prevented from rolling or winding up on the transfer cylinder due to the adhesion of the web to ink residues which may remain on the respective transfer cylinder Depending upon the assembly location of the auxiliary control or adjusting unit, stop surfaces are provided on a frame-fixed bearing support as well as on an intermediate and a lower displaceable printing-unit cylinder bearing support, respectively. The stop surfaces prevent movement of the displaceably supported printing-unit cylinders when the adjusting element of the auxiliary control or adjusting unit is activated.

Other features which are considered as characteristic for the invention are set forth in the appended claims.

Although the invention is illustrated and described herein as embodied in a device for adjusting printing unit cylinders in printing units of rotary printing presses, it is nevertheless not intended to be limited to the details shown, since various modifications and structural changes may be made therein without departing from the spirit of the invention and within the scope and range of equivalents of the claims.

Other features which are considered as characteristic for the invention are set forth in the appended claims.

Although the invention is illustrated and described herein as embodied in a device for adjusting printing unit cylinders in printing units of rotary printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
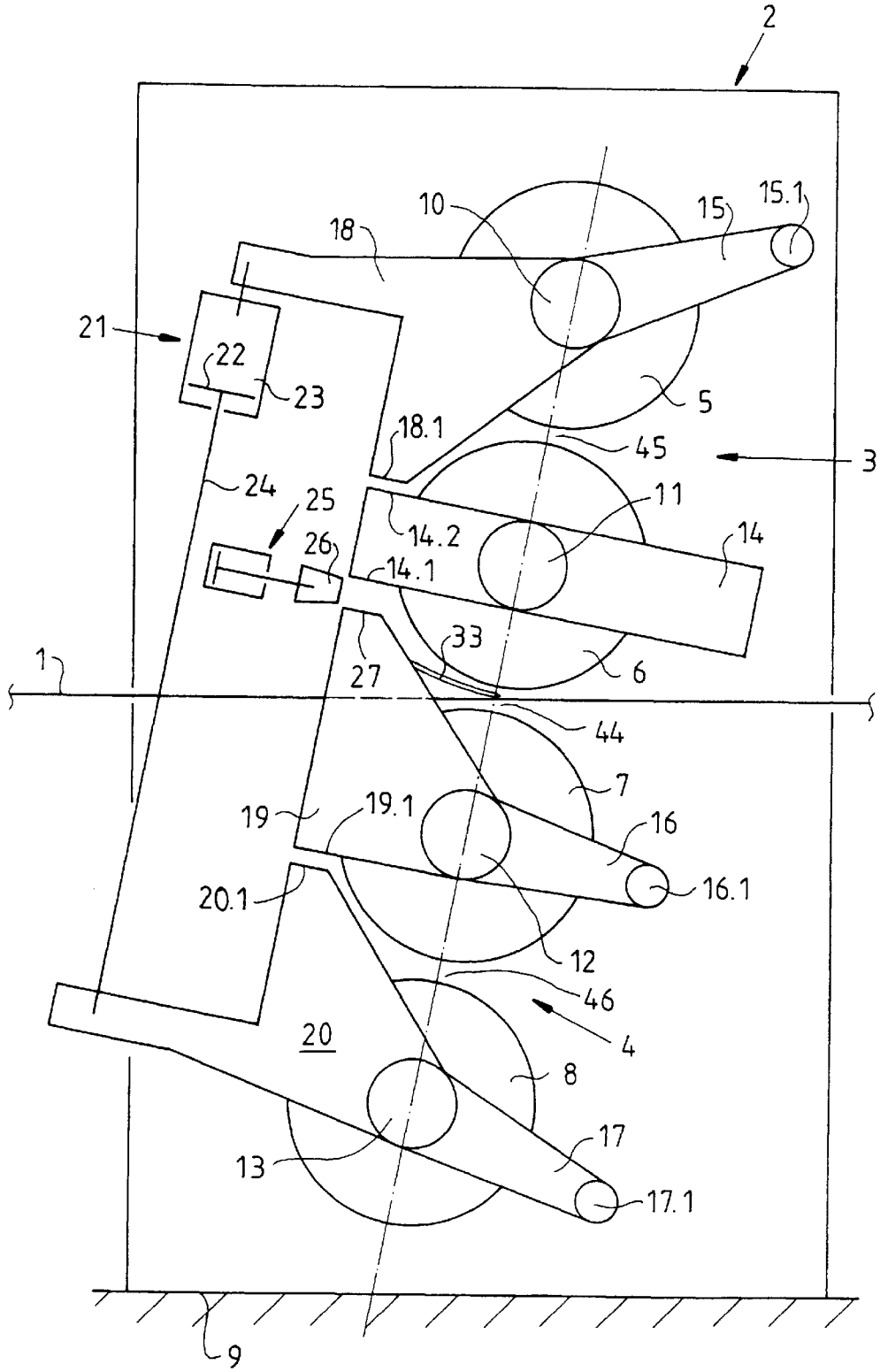
FIG. 1 is a diagrammatic side elevational view of a double printing unit with an adjustment unit and an auxiliary adjustment unit.

Referring now to the drawings and, first, particularly to FIG. 1 thereof, there is shown therein a double printing unit 2 for printing a material web 1 on both sides thereof, the double printing unit 2 including an upper printing-unit part 3 and a lower printing-unit part 4. The upper printing-unit part 3 is made up of an upper printing unit cylinder, i.e., the upper printing-form cylinder, rotating about a shaft 10, and an upper transfer cylinder 6 which, however, is received in a housing or frame-fixed bearing support 14 and rotates about a shaft 11. The lower printing-unit part 4 includes a lower transfer cylinder 7 rotating about a shaft 12, and a lower printing-form cylinder 8 which rotates about a shaft 13.

The upper printing-form cylinder 5 of the upper printing-unit part 3 is mounted in an upper rotating arm 15 which is movable about a pivot point 15.1. The lower transfer cylinder 7 of the lower printing-unit part 4 is held in an intermediate rotating arm 16 with an intermediate bearing support 19, the rotating arm 16 being pivotable about a pivot point 16.1. Likewise, the lower printing-unit cylinder 8, namely, the lower printing-form cylinder, is held in a lower rotating arm 17 which is pivotable about a pivot point 17.1. In the operating phase of the adjustment device according to the invention, as shown in FIG. 1, both of the transfer cylinders 6 and 7 of the respective printing-unit parts 3 and 4 are disengaged from one another and define a gap 44 therebetween through which the material web passes. The upper printing-form cylinder 5 and the upper transfer cylinder 6 are disposed within the upper printing-unit part 3 in an operating phase wherein they are disengaged from one another, so that a gap 45 is formed in the upper printing-unit part 3. The lower printing-form cylinder 8 and the lower transfer cylinder 7 of the lower printing-unit part 4 also define a gap 46 in the lower printing-unit part 4 in the operational phase wherein the cylinders 7 and 8 are disengaged from one another. At the web infeed side of the printing unit 2, in the embodiment shown in FIG. 1, a control unit 21 is provided which connects the upper bearing support 18 of the upper transfer cylinder 5 to the lower bearing support 20 of the lower transfer cylinder 8. The control or adjusting unit 21 is constructed as a piston/cylinder unit 22, 23 and acts upon a piston rod 24.

An auxiliary control or adjusting unit 25 including a translatorily displaceable adjusting element 26 is further provided in the embodiment of the invention shown in FIG. 1, the auxiliary unit 25 being disposed opposite to the upper printing unit 3. The adjusting element 26, provided in trapezoidal form in the embodiment of FIG. 1, is introducible between the bearing support 14, which is fixed to the frame of the printing unit 2, and the intermediate bearing support 19, which is formed with a stop surface 27. The gap 44 is thereby held open in the disengaged condition of the respective printing-unit cylinder 6, 7 placed next to the material web 1. Through the intermediary of the control or adjusting unit 21, it is possible to effect an engagement of the upper and lower printing-form cylinders 5 and 8, respectively, with the respective transfer cylinder 6, 7 prescribed by the auxiliary control or adjusting unit 25.

Thus, a new printing form can be suspended at the leading edge thereof, for example, on the upper transfer cylinder 5 of the upper printing-unit part 3. For correctly fitting the printing form on the outer cylindrical surface of the upper printing-form cylinder 5, the two transfer cylinders 6 and 7 are initially blocked by the control or adjusting unit 25, i.e., the gap 44 is protected, and the material web is free. Thereafter, the upper printing-form cylinder 5 can be engaged with the upper transfer cylinder 6, the printing form is mounted or locked on the upper printing-form cylinder 5 uniformly by the surface of the upper transfer cylinder 6, so that subsequently a correct clamping of the printing form behind the edge thereof, thereby locking the printing form, can take place. The peripheral surface of the upper transfer cylinder 6 can thus be used as the contact or pressure surface for the printing form which is to be newly fitted or mounted.

Figure 2:
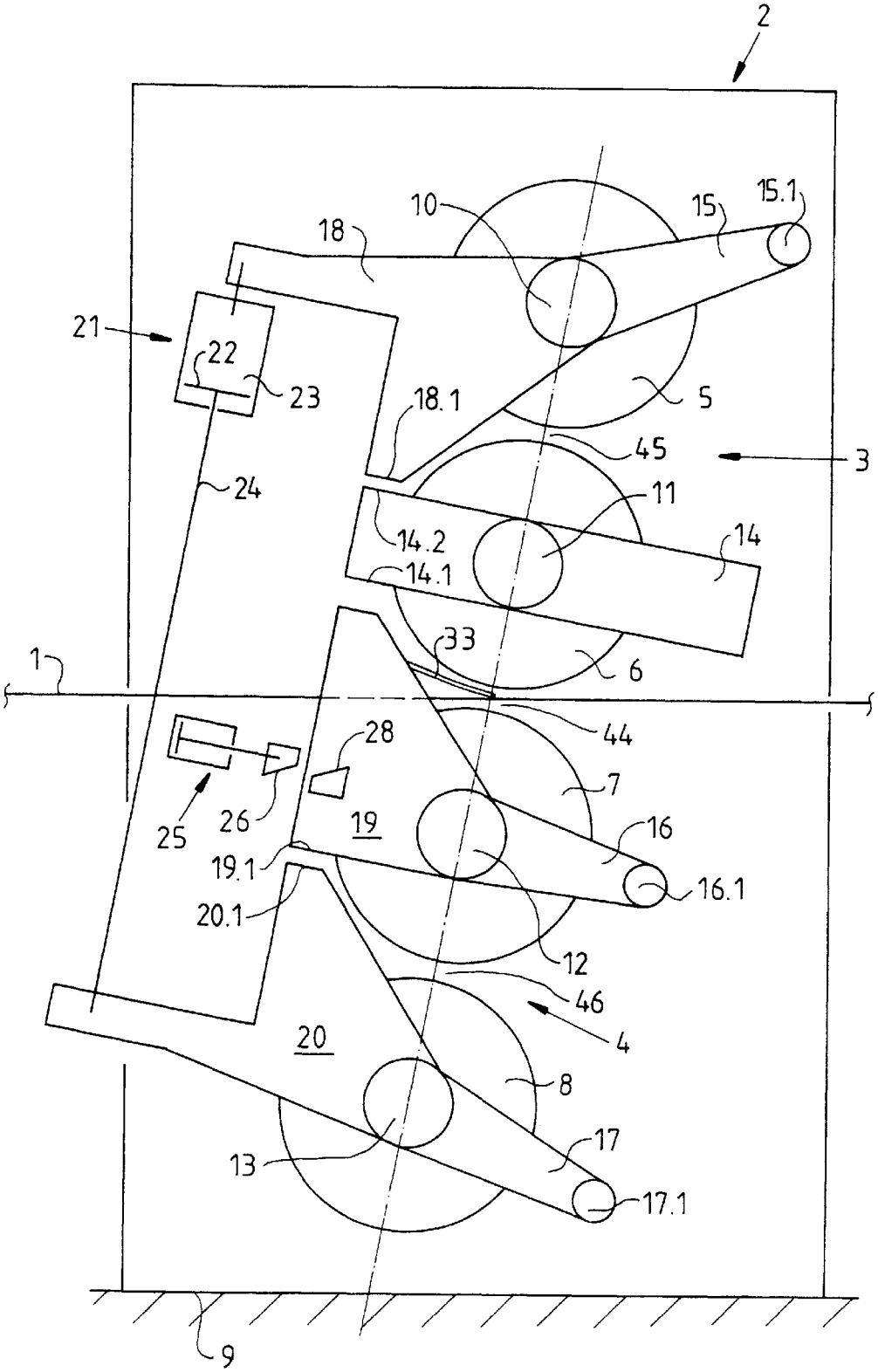
FIG. 2 is a view like that of FIG. 1 wherein the auxiliary adjustment unit is disposed opposite an intermediate bearing support.

FIG. 2 shows a double printing unit like that of FIG. 1, with the auxiliary control or adjusting unit 25 located opposite the middle bearing support 19. In this configuration of the double printing unit 2 with two printing-unit parts 3 and 4, the material web is printed on both sides thereof. Analogous to the device shown in FIG. 1, the upper printing-form cylinder 5 rotating about a shaft 10 is pivotable with a pivot arm 15 which is mounted so as to be pivotable about a pivot point 15.1. The upper transfer cylinder 6 belonging to the upper printing-unit part 3 is held in a bearing support 14 fixed to the frame of the printing press. The lower printing-unit part 4 is of analogous construction, the lower printing-form cylinder 8 thereof being pivotable about the pivot point 17.1, just as the lower transfer cylinder 7 of the lower printing-unit part 4 is likewise movable about the pivot point 16.1.

Through the intermediary of the control or adjusting unit 21, which can be constructed as the piston/cylinder control or adjusting unit 22, 23 acting upon the piston rod 24, the printing-unit cylinders 5, 7 and 8 are disengageable from and engageable with one another, respectively, the upper transfer cylinder 6 being mounted so as to be fixed to the printing press frame. In the operating phase shown in FIG. 2, the outer cylindrical surfaces of all of the printing-unit cylinders 5, 6, 7 and 8 are disengaged from one another. Furthermore, after all of the printing-unit cylinders 5, 6, 7 and 8 have been disengaged from one another, an upper and a lower gap 45, 46, respectively, is consequently formed between the printing-unit cylinder pairs of one of each printing-unit part 3,4, respectively. Between the transfer cylinders 6 and 7, which are disposed, respectively, on both sides of the material web 1, there is formed a gap 44 through which the material web 1 passes and in which the material web 1 can remain undamaged if the middle bearing support 19 is blocked by the auxiliary control or adjusting unit 25 assigned thereto in the embodiment of FIG. 2. In the embodiment illustrated therein, the middle bearing support 19 is blocked by the adjusting element 26 which, in this case, is formed with a wedge-shaped stop surface. The wedge-shaped stop surface of the adjusting element 26 travels over a stop 28 provided on the middle bearing support 19 and likewise formed with a wedge-shaped stop surface, and thereby impedes or stops the pivoting movement thereof, so that the lower transfer cylinder 7 remains in position in order to keep open the gap 44 wherein the material web 1 is located.

The instant the auxiliary control or adjusting unit 25 has blocked the movement of the middle bearing support 19 and consequently safeguarded or protected the gap 44, the upper and the lower printing-form cylinders 5 and 8, respectively, for example, when the printing form is being changed, can be brought into engagement with the respective transfer cylinder 6, 7, which is fixed in the position thereof. The possibility of moving the two printing-form cylinders 5 and 8 with the aid of the control or adjusting unit 21, independently of the transfer cylinders 6 and 7, permits the printing form to be uniformly applied by applying pressure thereto through the intermediary of the respective transfer cylinder 6, 7, when an exchange of printing forms takes place. With the aid of the mutually independent control or adjusting units 21 and 25, the printing-form cylinders 5 and 8 are able to engage or disengage independently of the adjustment or set position of the respective transfer cylinders 6 and 7, so that the material web 1 can remain in the gap 44 of the double printing unit.

In the operating phase of the embodiment shown in FIG. 2, during the throw-on impression by the control or adjusting unit 21 after the middle bearing support 19 has been fixed by the auxiliary control or adjusting unit 25, the lower gap 46 is closed by the engagement of the lower bearing support 20, i.e., a stop surface 20.1 thereof, with a stop surface 19.1 of the middle bearing support 19, and the surfaces of the lower transfer cylinder 7 and the lower printing-form cylinder 8 are in contact with one another. In an analogous manner, during the throw-on impression by the control or adjusting unit 21, a stop surface 18.1 of the upper bearing support 18 contacts the upper side 14.2 of the frame-fixed bearing support 14 of the upper transfer cylinder 6. Consequently, when the gap 44 is kept open, the material web 1 can remain in the double printing unit 2, because the engagement of the respective printing-form cylinder 5, 8 during an exchange of printing forms, for example, with the transfer cylinders 6 and 7, makes a change in the position thereof obsolete.

Figure 3:
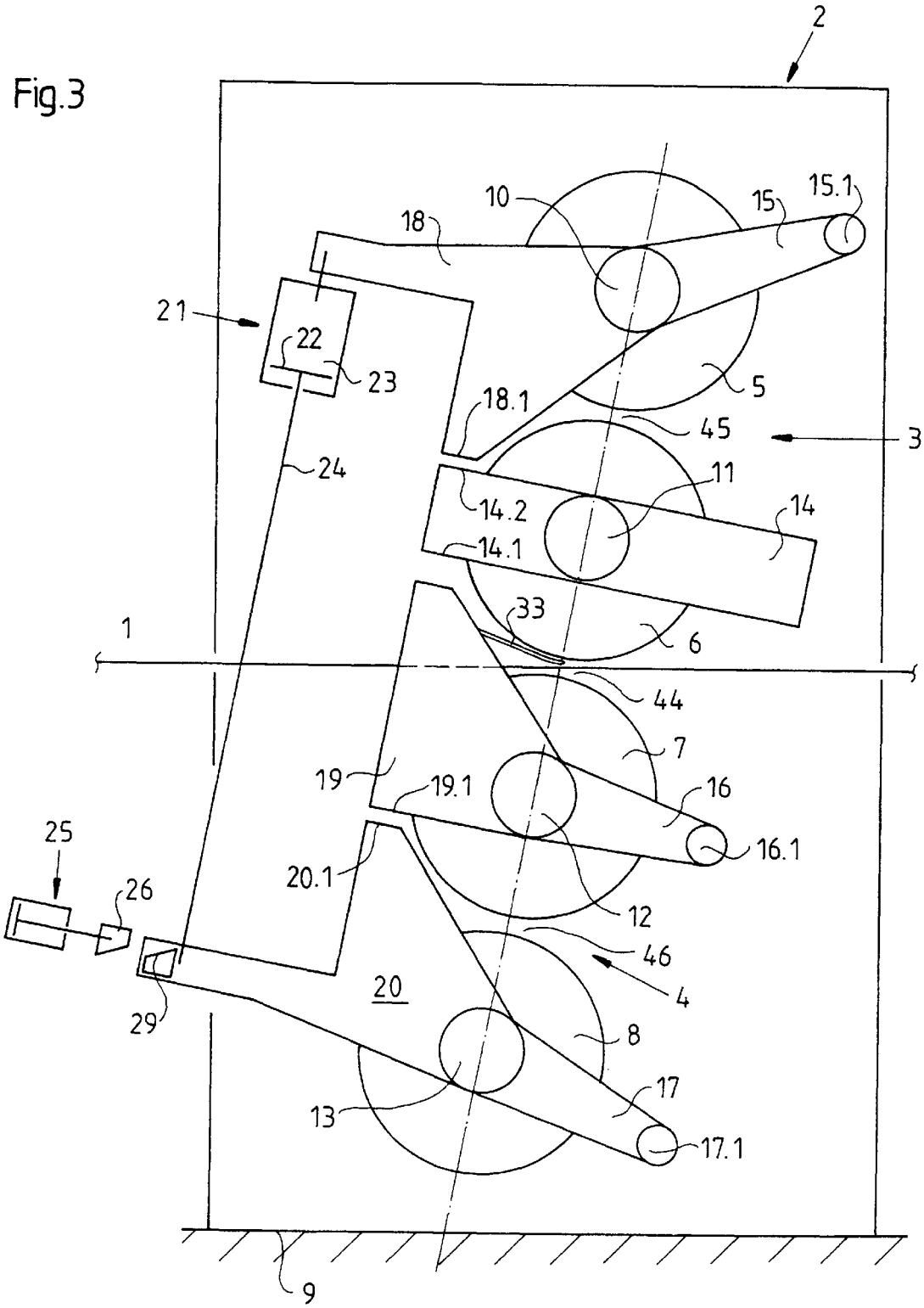
FIG. 3 is a view like those of FIGS. 1 and 2 wherein the auxiliary adjustment unit is disposed opposite a lower printing-unit cylinder bearing support.

FIG. 3 shows the double printing unit 2 with an auxiliary control or adjusting unit 25 disposed opposite the lower bearing support 20. With this embodiment of the invention, the lower bearing support 20 can be fixed by activating the auxiliary control or adjusting unit 25 and outwardly driving the adjusting element 26. The gap 26 can accordingly be only negligibly affected, the contact surfaces 20.1 and 19.1 remaining out of contact with one another. The upper gap 45 in the upper printing-unit part 3 can be influenced, however, by the control or adjusting unit 21, because the upper bearing support 18 is pivotable as before, and the upper printing-form cylinder 5 is consequently engageable with the upper transfer cylinder 6, so that the gap 45 is closed threat. In this illustrated embodiment, the smoothing action which occurs when the printing form is applied to or mounted on the outer cylindrical surface of the upper transfer cylinder 5 can consequently be utilized, whereas in the lower printing-unit part 4, the gap 46 is kept substantially constant.

Figure 4:
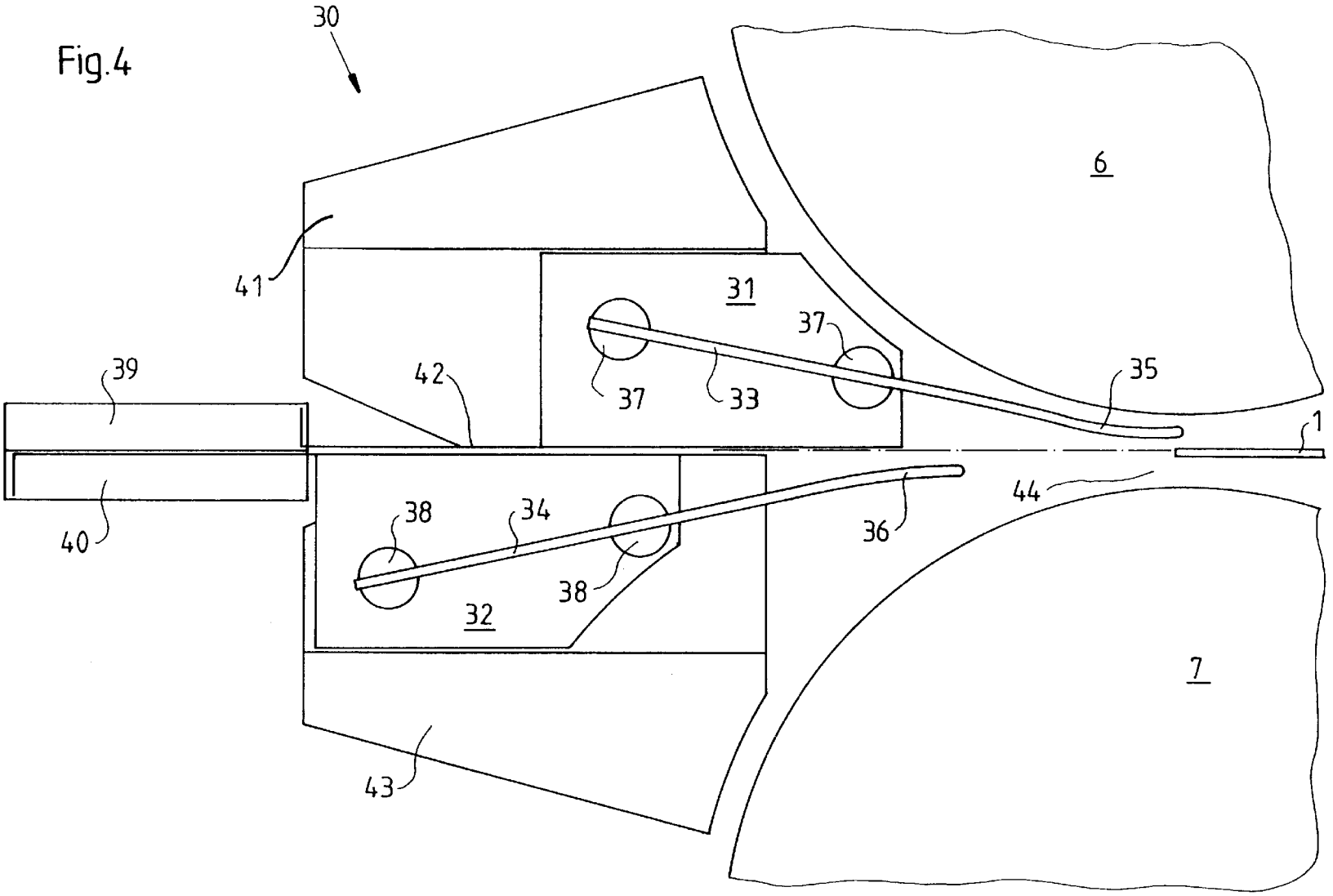
FIG. 4 is an enlarged fragmentary view of any of FIGS. 1, 2 and 3 showing a web-guiding unit located on a web infeed side of the double printing unit.

In FIG. 4, a web guidance unit 30 installed on the double printing unit at the web infeed side thereof is shown in detail. The web guidance unit 30 includes an upper housing part 41, as well as a lower housing part 43, wherein upper and lower sliders 31 and 32, respectively, are displaceably mounted. Respective protective elements 33 and 34 are attached to the sliders 31 and 32 and, at respective ends thereof directed towards the gap 44, are formed with a slight curvature 35, 36 corresponding somewhat to the curvature of the respective transfer cylinders 6 and 7 disposed on both sides of the material web 1. The protective elements 33 and 34 are held by respective bearing supports 37 and 38 provided on the sliders 31 and 32, respectively, which are actuable with respective separate upper and lower adjusting units 39 and 40. The adjusting units 39 and 40 which are only diagrammatically illustrated herein may be hydraulically or pneumatically actuated, it also being conceivable that they be actuated by servomotors of any serviceable type. With the aid of the illustrated finger-shaped protective elements 33 and 34 displaceable into the gap 44, a material web 1 which is to be introduced can be held away from the outer cylindrical surfaces of the transfer cylinders 6 and 7, so that the web 1 does not adhere to those surfaces due to any ink residue that may be adhering thereto and thus wind itself around the transfer cylinders 6 and 7. The curvatures 35 and 36 of the respective protective elements 33 and 34 form a type of funnel-shaped inlet which protects the material web 1 from contact with the transfer cylinders 6 and 7 at the inlet or infeed side of the gap 44.

We claim:

1. Device for adjusting printing-unit cylinders in a printing unit of a rotary printing press for printing on both sides of a material web, the printing-unit cylinders including printing-form cylinders with exchangeable printing forms, one of the printing-unit cylinders being held stationary in the printing unit, comprising an auxiliary adjusting unit for maintaining a gap traversible by the material web, said gap being formed between outer cylindrical surfaces of two of said printing-unit cylinders disposed adjacent to a path of the material web through the printing unit, said gap being maintainable by said auxiliary adjusting unit independently of adjusted positions of others of the printing-unit cylinders.

2. Adjusting device according to claim 1, comprising a primary adjusting unit for opening and closing, independently of the position of transfer cylinders disposed in upper and lower parts of the printing unit, a gap formed between one of the printing-unit cylinders disposed in the upper part of the printing unit and the transfer cylinder also disposed in the upper part of the printing unit.

3. Adjusting device according to claim 1, comprising a primary adjusting unit for opening and closing, independently of the position of transfer cylinders disposed in upper and lower parts of the printing unit, a gap formed between one of the printing-unit cylinders disposed in the lower part of the printing unit and the transfer cylinder also disposed in the lower part of the printing unit.

4. Adjusting device according to claim 1, wherein the printing-unit cylinders are disposed in both an upper and a lower printing-unit part, said auxiliary adjusting unit being assigned to said upper printing-unit part.

5. Adjusting device according to claim 1, wherein the printing-unit cylinders are disposed in both an upper and a lower printing-unit part, said auxiliary adjusting unit being assigned to said lower printing-unit part.

6. Adjusting device according to claim 1, wherein the printing-unit cylinders are disposed in both an upper and a lower printing-unit part, and including a printing-unit cylinder bearing support disposed in said lower printing-unit part, said auxiliary adjusting unit being assigned to said cylinder bearing support in said lower printing-unit part.

7. Adjusting device according to claim 1, including a web guidance unit disposed in the printing unit at a web-infeed side thereof, said web guidance unit having a protective element insertable into said gap.

8. Adjusting device according to claim 7, including a slider whereon said insertable protective element is held.

9. Adjusting device according to claim 8, including a control unit assigned to said slider for actuating said slider.

10. Adjusting device according to claim 1, including an upper, a lower and an intermediate displaceable bearing support for the printing-unit cylinders, and a frame-fixed bearing support located adjacent to said intermediate bearing support, and an adjusting element for said auxiliary adjusting unit displaceable between said frame-fixed bearing support and said intermediate bearing support.

11. Adjusting device according to claim 10, wherein said intermediate bearing support is formed with a stop surface.

12. Adjusting device according to claim 1, including an upper and a lower bearing support for the printing-unit cylinders, said lower bearing support being formed with a stop surface.

* * * * *